US010064431B2

(12) United States Patent
Li et al.

(10) Patent No.: US 10,064,431 B2
(45) Date of Patent: Sep. 4, 2018

(54) ATOMIZER AND ELECTRONIC CIGARETTE HAVING SAME

(71) Applicant: Shenzhen First Union Technology Co., Ltd., Shenzhen, Guangdong Province (CN)

(72) Inventors: Yonghai Li, Shenzhen (CN); Zhongli Xu, Shenzhen (CN); Shuyun Hu, Shenzhen (CN)

(73) Assignee: SHENZHEN FIRST UNION TECHNOLOGY CO., LTD., Shenzhen, Guangdong Province (CN)

( * ) Notice: Subject to any disclaimer, the term of this patent is extended or adjusted under 35 U.S.C. 154(b) by 348 days.

(21) Appl. No.: 14/822,889

(22) Filed: Aug. 10, 2015

(65) Prior Publication Data

US 2016/0044966 A1 Feb. 18, 2016

(30) Foreign Application Priority Data

Aug. 12, 2014 (CN) ..... 2014 2 0450935 U

(51) Int. Cl.
*A24F 47/00* (2006.01)

(52) U.S. Cl.
CPC ..... *A24F 47/008* (2013.01)

(58) Field of Classification Search
CPC ..... A24F 47/008; A24F 47/002; A61M 15/06
See application file for complete search history.

(56) References Cited

U.S. PATENT DOCUMENTS

2011/0303231 A1* 12/2011 Li ..... A24F 47/008 131/329
2012/0111347 A1* 5/2012 Hon ..... A24F 47/008 131/329
2013/0263869 A1* 10/2013 Zhu ..... A24F 47/002 131/329
2013/0306064 A1* 11/2013 Thorens ..... A24F 47/008 128/202.21
2013/0319407 A1* 12/2013 Liu ..... A61M 15/06 128/202.21
2014/0076310 A1* 3/2014 Newton ..... A61M 15/06 128/202.21
2014/0130796 A1* 5/2014 Liu ..... A24F 47/008 128/202.21
2014/0150785 A1* 6/2014 Malik ..... A61M 15/06 128/202.21
2014/0318558 A1* 10/2014 Liu ..... A24F 47/002 131/329
2015/0258288 A1* 9/2015 Sullivan ..... A61M 15/0086 128/203.12
2016/0353802 A1* 12/2016 Malgat ..... A24F 47/008

OTHER PUBLICATIONS

European Written Opinion for application EP 15180648 dated Dec. 15, 2015.*

* cited by examiner

*Primary Examiner* — Michael J Felton
*Assistant Examiner* — Jerzi H Moreno Hernandez
(74) *Attorney, Agent, or Firm* — Cheng-Ju Chiang

(57) ABSTRACT

An exemplary atomizer includes a housing and a mouthpiece assembly. The housing defines a liquid chamber for storing tobacco liquid. The mouthpiece assembly is arranged at a first end of the housing. The mouthpiece assembly defines an air passage and a backflow chamber. The backflow chamber includes a closed bottom end away from the housing, and an open near end adjacent to the housing. The open end is in communication with the air passage.

11 Claims, 6 Drawing Sheets

ATOMIZER AND ELECTRONIC CIGARETTE HAVING SAME

TECHNICAL FIELD

The present invention relates to electronic cigarettes, and particularly to an atomizer and an electronic cigarette using same.

BACKGROUND ART

A typical electronic cigarette includes an atomizer and a power supply. The atomizer includes a mouthpiece, a liquid conducting component for absorbing tobacco liquid, and a heating wire for heating the tobacco liquid to vaporize. The liquid conducting component and the heating wire may be arranged at a front end, a middle part, or a rear end of the atomizer.

However, there are shortcomings if the liquid conducting component and the heating wire are simply arranged in these positions. When the liquid conducting component and the heating wire are arranged in the middle part, it is inconvenient to replace the liquid conducting component and the heating wire. When the liquid conducting component and the heating wire are arranged at the rear end, the tobacco liquid may leak from the rear end. When the liquid conducting component and the heating wire are arranged at the front end, the user of the atomizer may suck tobacco liquid in the liquid conducting component from the mouthpiece.

What are needed, therefore, are an atomizer and an electronic cigarette using same, which can overcome the above shortcomings.

SUMMARY

An exemplary atomizer includes a housing and a mouthpiece assembly. The housing defines a liquid chamber for storing tobacco liquid. The mouthpiece assembly is arranged at a first end of the housing. The mouthpiece assembly defines an air passage and a backflow chamber. The backflow chamber includes a closed bottom end away from the housing, and an open near end adjacent to the housing. The open end is in communication with the air passage.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
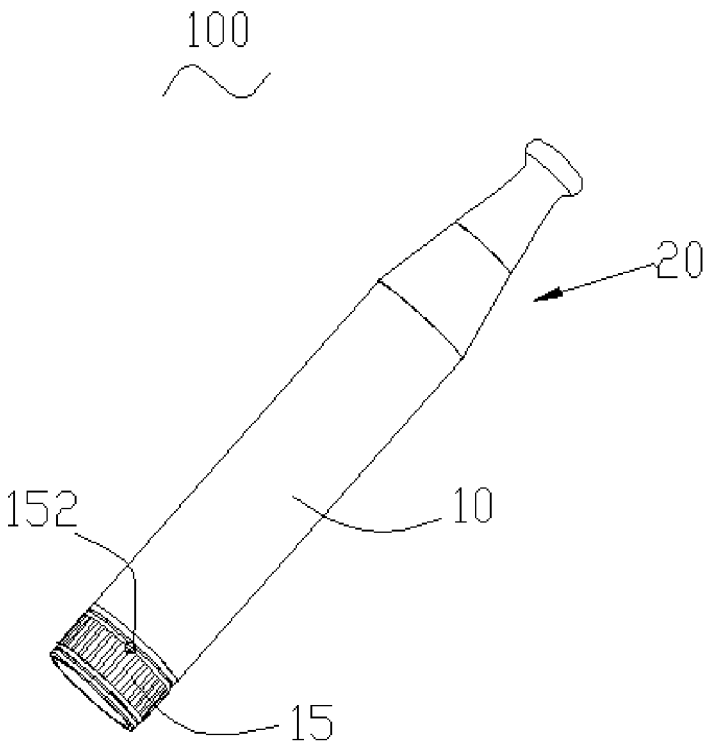
FIG. 1 is a perspective view of an atomizer according to a first embodiment.
Figure 2:
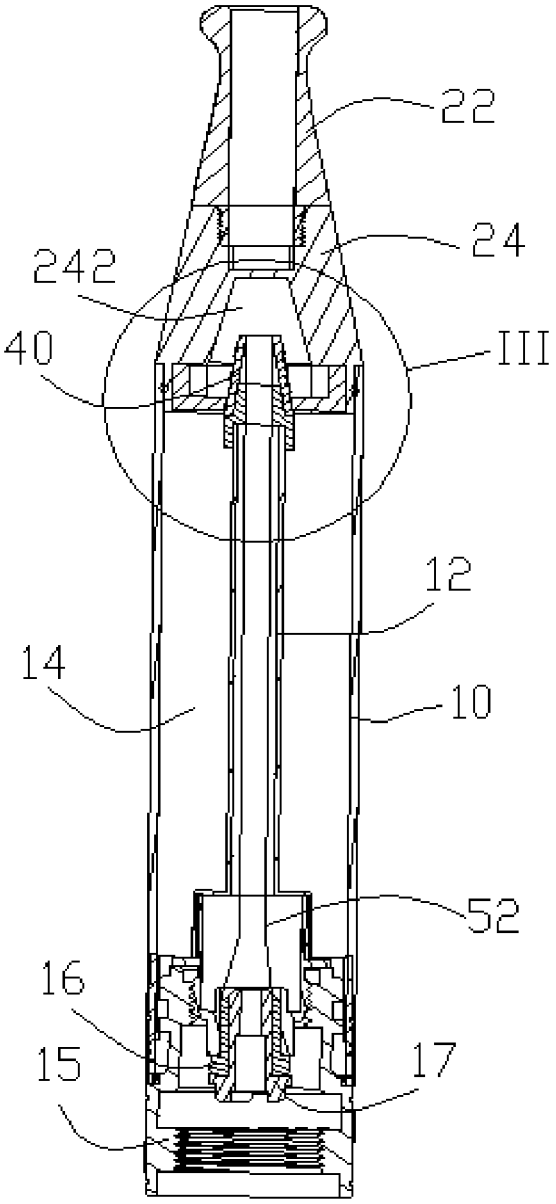
FIG. 2 is a cross-sectional view of the atomizer of FIG. 1, taken along a first central plane.
Figure 3:
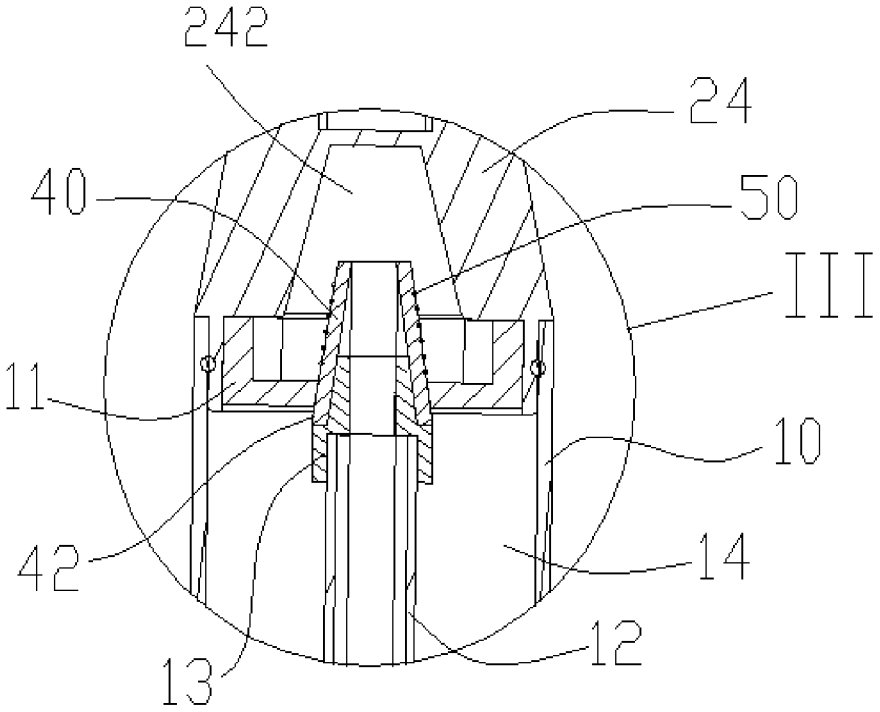
FIG. 3 is an enlarged view of area III of the atomizer of FIG. 2.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Several definitions that apply throughout this disclosure will now be presented.

The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

Referring to FIGS. 1-5, an atomizer 100 according to a first embodiment is shown. The atomizer 100 includes an housing 10, a mouthpiece assembly 20, a porous liquid conducting component 40 and a heating wire 50. The mouthpiece assembly 20 is arranged at an end of the housing 10. The porous liquid conducting component 40 and the heating wire 50 are arranged between the housing 10 and the mouthpiece assembly 20.

In the present embodiment, the housing 10 is transparent. An air pipe 12 is provided in the housing 10. The housing 10 and the air pipe 12 cooperatively define an annular liquid chamber 14. An end of the housing 10 away from the mouthpiece assembly 20 is provided with a screw sleeve 15. An insulating ring 16 and a tubular electrode 17 are arranged in the screw sleeve 15. The tubular electrode 17 is kept insulated from the screw sleeve 15 by the insulating ring 16. The screw sleeve 15 is coupled with the housing 10 by interference fit, so that liquid leakage is eliminated. The screw sleeve 15 defines an air inlet 152.

Figure 4:
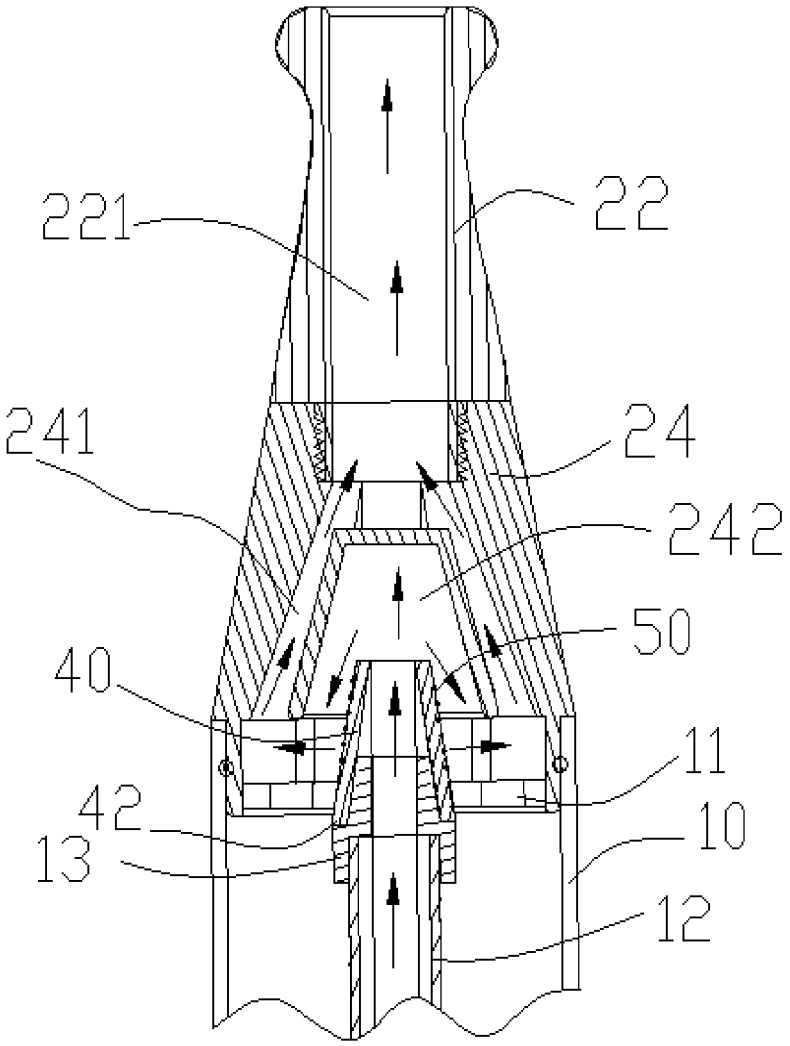
FIG. 4 is another perspective view of an atomizer of FIG. 1, taken along a second plane perpendicular to the first central plane.

The housing 10 is provided with a hollow bracket 11 in an end adjacent to the mouthpiece assembly 20. A hollow silica holder 13 is arranged on the air pipe 12. The porous liquid conducting component 40 is hollow, nests the silica holder 13 and extends through the bracket 11. The air pipe 12 is in communication with the silica holder 13 and the porous liquid conducting component 40, so that air can reach a surface of the porous liquid conducting component 40, as seen in FIG. 4. The bracket 11 and the silica holder 13 are configured (i.e., structured and arranged) for sealing tobacco liquid in the liquid chamber 14. A bottom end 42 of the porous liquid conducting component 40 exposes from the silica holder 13 and the bracket 11, and is in contact with the tobacco liquid in the liquid chamber 14 for absorbing the tobacco liquid. The heating wire 50 is wound around the porous liquid conducting component 40. In the present embodiment, the bracket 11 is also made of silica. The liquid conducting component 40 is made of ceramic, and is a hollow truncated cone. The liquid conducting component 40 is coaxial with the housing 10, and a smaller end of the liquid conducting component 40 faces the mouthpiece assembly 20. Two opposite ends 52 of the heating wire 50 extend through the air pipe 12 to electrically connect with the screw sleeve 15 and the tubular electrode 17.

Figure 5:
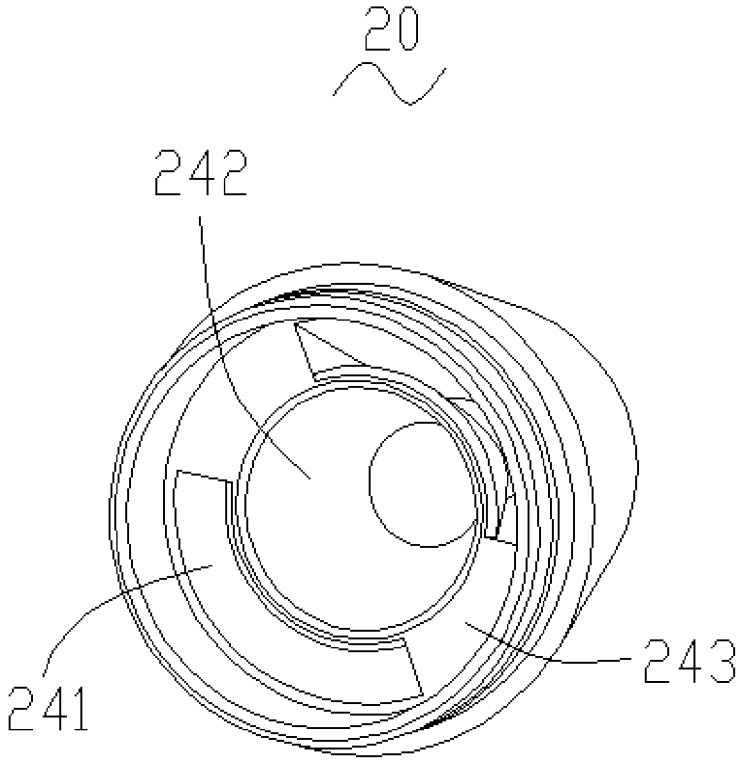
FIG. 5 is a perspective view of a rear end of a mouthpiece assembly of the atomizer of FIG. 1.

The mouthpiece assembly 20 includes a front end 22 and a rear end 24. In the present embodiment, the front end 22 is threadedly coupled with the rear end 24. The front end 22 defines a central through hole 221. The rear end 24 defines an air passage 241 and a backflow chamber 242. The backflow chamber 242 includes a bottom end away from the housing 10, and a near end adjacent to the housing 10. The bottom end is closed; the near end is open, and is in communication with the air passage 241. Referring to FIG. 5, an inner wall of the backflow chamber 242 is connected to an inner wall of the rear end 24 via the two spaced arms 243. That is, the backflow chamber 242 and the rear end 24 are integrally formed. The central through hole 221 aligns with the bottom end of the backflow chamber 242, and the air passage 242 communicates with the central through hole 221. The inner wall of the backflow chamber 242 inclines from the bottom end to the near end, thus facilitating backflow of tobacco liquid.

Part of the liquid conducting component 40 and part of the heating wire 50 are inserted into the backflow chamber 242. The bottom end 42 of the liquid conducting component 40 absorbs the tobacco liquid from the liquid chamber 14, and then the heating wire 50 heats the tobacco liquid in the liquid conducting component 40 to form aerosol. As seen in FIG. 4, the aerosol passes through the air passage 241, the central through hole 221, and then reaches a mouth of a user. The backflow chamber 242 prevents the tobacco liquid in the liquid conducting component 40 from being sucked via the mouthpiece assembly 20. During the aerosol inhalation, some aerosol may reach the inner wall of the backflow chamber 242, the backflow chamber 242 condenses the aerosol into tobacco liquid, and the condensed tobacco liquid flows back to the liquid conducting component 40 via the inner wall of the backflow chamber 242. In the present embodiment, the configuration of the backflow chamber 242 prevents the user from sucking tobacco liquid in the liquid conducting component 40 from the mouthpiece assembly 20.

Figure 6:
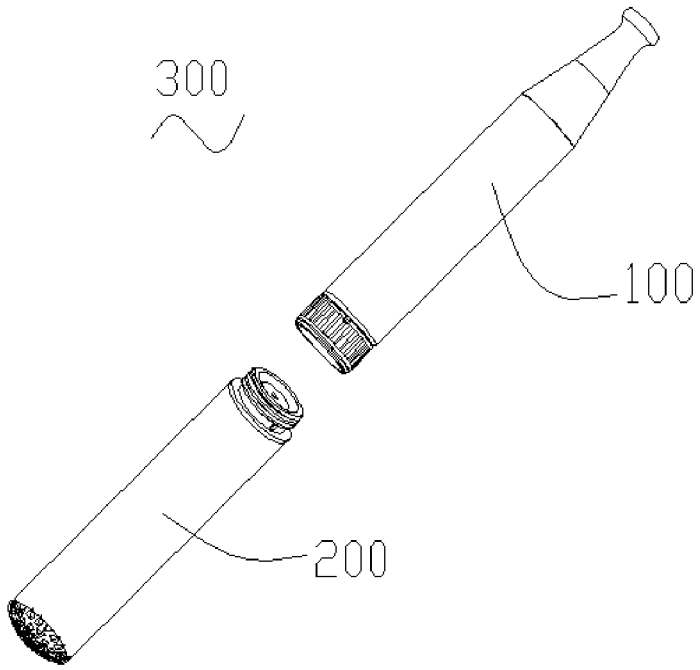
FIG. 6 is a perspective view of an electronic cigarette according to a second embodiment when not assembled.

Referring to FIG. 6, an electronic cigarette 300 according to a second embodiment is shown. The electronic cigarette 300 includes the atomizer 100 in the first embodiment, and a power supply 250. The power supply 250 is configured for supplying the atomizer 100 power. The power supply 250 is detachably connected to the atomizer 100.

It is understood that the above-described embodiments are intended to illustrate rather than limit the disclosure. Variations may be made to the embodiments and methods without departing from the spirit of the disclosure. Accordingly, it is appropriate that the appended claims be construed broadly and in a manner consistent with the scope of the disclosure.

What is claimed is:

1. An atomizer for an electronic cigarette, comprising:

a housing defining a liquid chamber for storing tobacco liquid;

an air pipe disposed in the housing and extending through the housing along an axis of the housing;

a mouthpiece assembly arranged at a first end of the housing, the mouthpiece assembly defining an air passage and a backflow chamber, the backflow chamber comprising a closed bottom end away from the first end of the housing and an open near end adjacent to the first end of the housing, the open end being in spatial communication with the air passage and the air pipe, respectively;

a porous liquid conducting component;

a heating wire wound around the liquid conducting component;

a hollow silica holder arranged at a distal end of the air pipe;

a hollow bracket arranged on the first end of the housing;

wherein the liquid conducting component is arranged between the hollow silica holder and the hollow bracket; and wherein the liquid conducting component passes through the silica holder and bracket such that a part of the liquid conducting component is inserted into the backflow chamber and another part of the of the liquid conducting component is inserted into the liquid chamber so as to convey the tobacco liquid to the heating wire for vaporization.

2. The atomizer of claim 1, wherein the heating wire is configured for heating the tobacco liquid in the liquid conducting component to form aerosol, and the aerosol is expelled from the mouthpiece assembly via the air passage.

3. The atomizer of claim 1, wherein the mouthpiece assembly comprises a front end and a rear end, the front end defines a central through hole, the air passage and the backflow chamber are arranged in the rear end, the central through hole faces the bottom end of the backflow chamber, and the central through hole is in spatial communication with the air passage.

4. The atomizer of claim 1, wherein the backflow chamber has an inner wall with an inclined surface.

5. The atomizer of claim 1, wherein the liquid conducting component is a hollow truncated cone, the liquid conducting component is arranged coaxially with the housing, a smaller end of the truncated cone faces the backflow chamber.

6. The atomizer of claim 1, further comprising a screw sleeve arranged at an opposite second end of the housing, wherein the screw sleeve defines an air inlet, the liquid conducting component is hollow, and the air pipe spatially communicates with the air inlet at one end thereof and with the liquid conducting component at the other end thereof.

7. The atomizer of claim 6, further comprising an insulating ring arranged in the screw sleeve, and a tubular electrode in the insulated ring, wherein two opposite ends of the heating wire pass through the air pipe, and are then electrically connected to the screw sleeve and the tubular electrode.

8. The atomizer of claim 1, wherein the liquid chamber is cooperatively defined between the housing and the air pipe, and the liquid chamber is annular.

9. The atomizer of claim 2, wherein the silica holder and the bracket cooperatively seal the liquid chamber.

10. An electronic cigarette, comprising:

an atomizer, comprising:

a housing defining a liquid chamber for storing tobacco liquid;

a hollow bracket disposed at a first end of the housing to close the liquid chamber;

an air pipe disposed in the housing and extending through the housing along an axis of the housing;

a hollow silica holder arranged at a distal end of the air pipe;

a mouthpiece assembly arranged at the first end of the housing and connected thereto, the mouthpiece assembly defining an air passage and a backflow chamber, the backflow chamber comprising a closed bottom end away from the first end of the housing and an open near end adjacent to the first end of the housing, the open end being in spatial communication with the air passage;

a porous liquid conducting component;

a heating wire wound around the liquid conducting component;

wherein the liquid conducting component is arranged between the hollow silica holder and the hollow bracket;

wherein the liquid conducting component passes through the silica holder and bracket such that a part of the liquid conducting component is inserted into the backflow chamber and another part of the of the liquid conducting component is inserted into the liquid chamber so as to convey the tobacco liquid to the heating wire; and wherein the heating wire is configured for heating the tobacco liquid in the liquid conducting component to form aerosol, and the aerosol is expelled from the mouthpiece assembly via the air passage; and a power supply configured for supplying power to the atomizer.

11. The electronic cigarette of claim 10, wherein the power supply is detachably connected with the atomizer.

* * * * *